US006082348A

United States Patent [19]

Savage

[11] Patent Number: 6,082,348

[45] Date of Patent: Jul. 4, 2000

[54] ARROW WEST

[76] Inventor: Huey P. Savage, 110 N. Front St., Oak Grove, La. 71263

[21] Appl. No.: 09/359,453

[22] Filed: Jul. 22, 1999

[51] Int. Cl.[7] ..... F41B 5/22

[52] U.S. Cl. ..... 124/44.5

[58] Field of Search ..... 124/24.1, 44.5

[56] References Cited

U.S. PATENT DOCUMENTS

| | | | |
|---|---|---|---|
| 2,691,974 | 10/1954 | Nelson | 124/44.5 |
| 3,372,686 | 3/1968 | Losh | 124/44.5 X |
| 4,278,066 | 7/1981 | Zinz | 124/44.5 |
| 4,343,286 | 8/1982 | Thacker | 124/24.1 |
| 4,473,058 | 9/1984 | Terry | 124/24.1 |
| 4,489,704 | 12/1984 | Troncoso | 124/24.1 |
| 4,548,189 | 10/1985 | Pietraszek et al. | 124/44.5 |
| 4,676,200 | 6/1987 | Pietraszek | 124/44.5 |
| 5,095,883 | 3/1992 | Kurtz | 124/25 |
| 5,503,136 | 4/1996 | Tone | 124/44.5 |
| 5,601,069 | 2/1997 | Clark | 124/44.5 |
| 5,606,961 | 3/1997 | Basik et al. | 124/44.5 |

*Primary Examiner*—John A. Ricci
*Attorney, Agent, or Firm*—Joseph N. Breaux

[57] ABSTRACT

An arrow rest with arrow shaft supports that pivot away from the arrow shaft with sufficient speed to prevent any of the arrow vanes from striking any of the arrow shaft supports. The arrow shaft supports are accelerated away from the arrow shaft by a spring tension force after a force generated by the moving arrow overcomes a magnetic holding force that holds the arrow shaft supports in an arrow shaft support position.

16 Claims, 4 Drawing Sheets

ARROW WEST

TECHNICAL FIELD

The present invention relates to arrow rests and more particularly to an arrow rest that includes arrow support tines that swing away from an arrow support position to prevent contact between the arrow shaft vanes and the arrow support tines; the arrow rest including a bow connecting structure, two arrow support tines rigidly secured to a first end of a pivot shaft rotatably entrapped in connection with the bow connecting structure, a biasing spring assembly including a torsion spring having a first end in connection with the bow connecting structure and a second end in user adjustable connection with the pivot shaft such that a torsional force is generated by positioning the two arrow support tines in an arrow shaft support position in a direction urging the two arrow support tines in a direction away from the arrow shaft support position, and a magnetic retaining assembly including a magnetic contact arm having a first contact arm end in rigid connection with the pivot shaft and a second contact arm end provided with a flat magnetically attractable contact surface, and a holding magnet affixed to the bow connecting structure at a location to magnetically attract and hold the flat magnetically attractable contact surface; the position of the two arrow support tines with respect to the magnetic contact arm being adjusted such that the two arrow support tines are in the arrow shaft support position when the flat magnetically attractable contact is magnetically held in a fixed position by a magnetic force from the holding magnet affixed to the bow connecting structure; the torsional force generated by the torsion spring being adjusted such that when the two arrow support tines are moved away from the arrow shaft support position by a force generated by an arrow shaft moving against the two arrow support tines the torsional force is sufficient to overcome the magnetic force of the holding magnet and rapidly rotate the two arrow support tines away from the arrow shaft support position such that vanes provided on a shaft end of the arrow shaft do not contact either of the two arrow support tines.

BACKGROUND ART

An arrow can be deflected from its intended path when one or more vanes secured to the shaft of the arrow strike one or more of the arrow shaft supports of the arrow rest. It would be desirable, therefore, to have an arrow rest with arrow shaft supports that pivot away from the arrow shaft with sufficient speed to prevent any of the arrow vanes from striking any of the arrow shaft supports. Because the arrow shaft supports must move rapidly away from the rapidly accelerating shaft of the arrow, it would be desirable if the arrow shaft supports were accelerated away from the arrow shaft by a spring tension force.

GENERAL SUMMARY DISCUSSION OF INVENTION

It is thus an object of the invention to provide an arrow rest that includes a bow connecting structure, two arrow support tines rigidly secured to a first end of a pivot shaft rotatably entrapped in connection with the bow connecting structure, a biasing spring assembly including a torsion spring having a first end in connection with the bow connecting structure and a second end in user adjustable connection with the pivot shaft such that a torsional force is generated by positioning the two arrow support tines in an arrow shaft support position in a direction urging the two arrow support tines in a direction away from the arrow shaft support position, and a magnetic retaining assembly including a magnetic contact arm having a first contact arm end in rigid connection with the pivot shaft and a second contact arm end provided with a flat magnetically attractable contact surface, and a holding magnet affixed to the bow connecting structure at a location to magnetically attract and hold the flat magnetically attractable contact surface; the position of the two arrow support tines with respect to the magnetic contact arm being adjusted such that the two arrow support tines are in the arrow shaft support position when the flat magnetically attractable contact is magnetically held in a fixed position by a magnetic force from the holding magnet affixed to the bow connecting structure; the torsional force generated by the torsion spring being adjusted such that when the two arrow support tines are moved away from the arrow shaft support position by a force generated by an arrow shaft moving against the two arrow support tines the torsional force is sufficient to overcome the magnetic force of the holding magnet and rapidly rotate the two arrow support tines away from the arrow shaft support position such that vanes provided on a shaft end of the arrow shaft do not contact either of the two arrow support tines.

It is a further object of the invention to provide an arrow rest that includes an elongated plastic shaft bearing insert with a spring positioning end positioned through and extending past a shaft hole provided through the bow connecting structure and around which coils of the torsion spring are positioned.

It is a still further object of the invention to provide an arrow rest as described above wherein the magnetic contact arm of the arrow rest includes a user adjustable contact arm set screw securable collar to the pivot shaft and to which the first contact arm end is rigidly connected.

It is a still further object of the invention to provide an arrow rest as described above wherein the second contact arm end is provided with a non-magnetically attractable plastic tubing section positioned around the flat magnetically attractable contact surface in a manner to contact the holding magnet when the flat magnetically attractable contact is magnetically held in the fixed position by the magnetic force from the holding magnet.

It is a still further object of the invention to provide an arrow rest as described above wherein the first end of the torsion spring is inserted into a hole provided into a sidewall of the bow connecting structure and the second end of the torsion spring is bent into a U-shape and positioned around a screw shaft of set screw of a spring tension set screw securable adjustment collar positioned on the pivot shaft.

It is a still further object of the invention to provide an arrow rest that accomplishes all or some of the above objects in combination.

Accordingly, an arrow rest is provided. The arrow rest includes a bow connecting structure, two arrow support tines rigidly secured to a first end of a pivot shaft rotatably entrapped in connection with the bow connecting structure, a biasing spring assembly including a torsion spring having a first end in connection with the bow connecting structure and a second end in user adjustable connection with the pivot shaft such that a torsional force is generated by positioning the two arrow support tines in an arrow shaft support position in a direction urging the two arrow support tines in a direction away from the arrow shaft support position, and a magnetic retaining assembly including a magnetic contact arm having a first contact arm end in rigid connection with the pivot shaft and a second contact arm end provided with a flat magnetically attractable contact surface, and a holding magnet affixed to the bow connecting structure at a location to magnetically attract and hold the flat magnetically attractable contact surface; the position of the two arrow support tines with respect to the magnetic contact arm being adjusted such that the two arrow support tines are in the arrow shaft support position when the flat magnetically attractable contact is magnetically held in a fixed position by a magnetic force from the holding magnet affixed to the bow connecting structure; the torsional force generated by the torsion spring being adjusted such that when the two arrow support tines are moved away from the arrow shaft support position by a force generated by an arrow shaft moving against the two arrow support tines, or a vibrational force transmitted to the arrow rest through the bow generated by releasing the bow string when the bow is drawn, the torsional force is sufficient to overcome the magnetic force of the holding magnet and rapidly rotate the two arrow support tines away from the arrow shaft support position such that vanes provided on a shaft end of the arrow shaft do not contact either of the two arrow support tines.

In a preferred embodiment the arrow rest further includes an elongated plastic shaft bearing insert with a spring positioning end positioned through and extending past a shaft hole provided through the bow connecting structure and around which coils of the torsion spring are positioned. In another preferred embodiment the magnetic contact arm of the arrow rest includes a user adjustable contact arm set screw securable collar to the pivot shaft and to which the first contact arm end is rigidly connected. In still another preferred embodiment, the second contact arm end is provided with a non-magnetically attractable plastic tubing section positioned around the flat magnetically attractable contact surface in a manner to contact the holding magnet when the flat magnetically attractable contact is magnetically held in the fixed position by the magnetic force from the holding magnet. In still another preferred embodiment the first end of the torsion spring is inserted into a hole provided into a sidewall of the bow connecting structure and the second end of the torsion spring is bent into a U-shape and positioned around a screw shaft of set screw of a spring tension set screw securable adjustment collar positioned on the pivot shaft.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
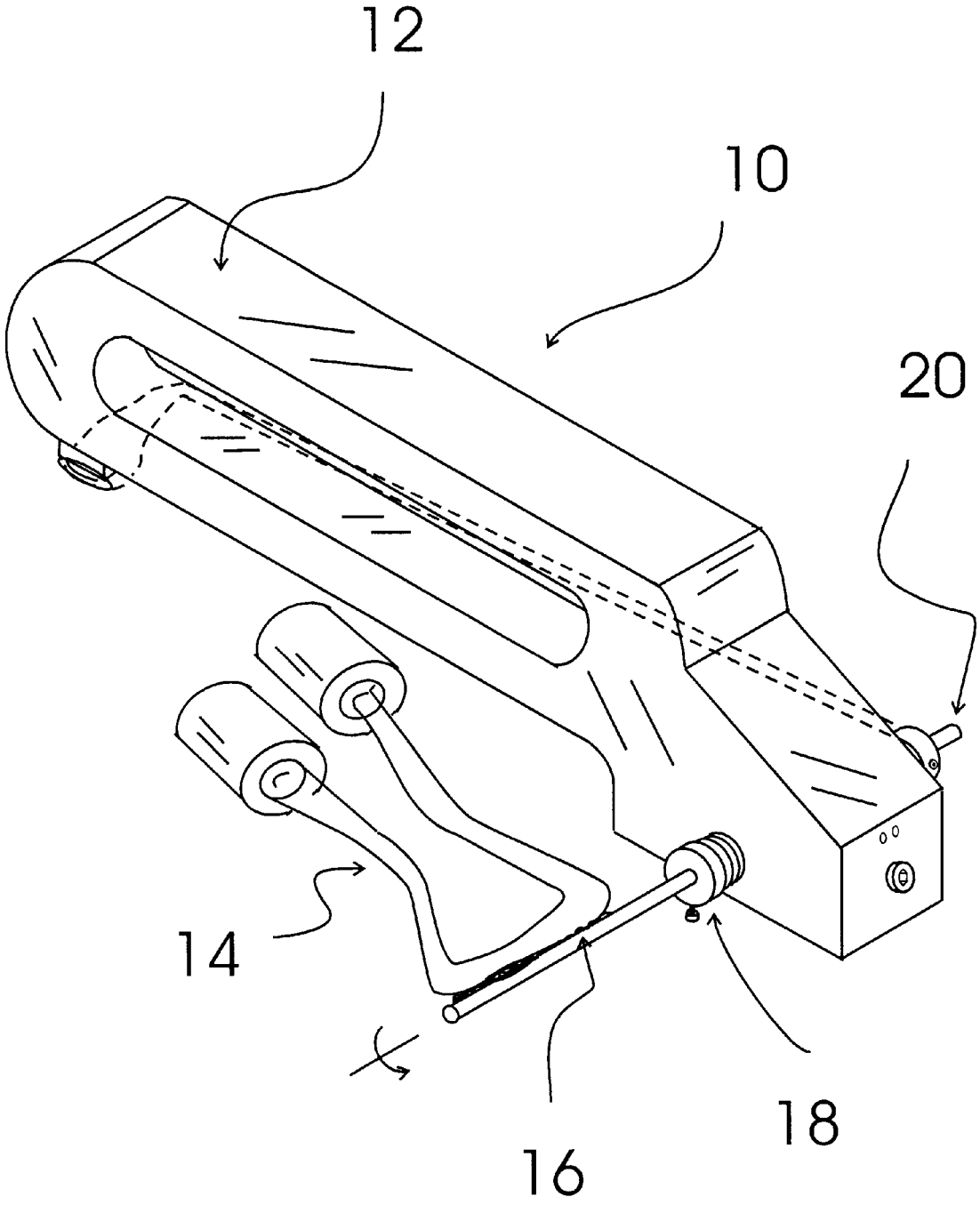
FIG. 1 is a perspective view of an exemplary embodiment of the arrow rest of the present invention showing the bow connecting structure, two arrow support tines rigidly secured to a first end of a pivot shaft rotatably entrapped in connection with the bow connecting structure, a biasing spring assembly including a torsion spring having a first end in connection with the bow connecting structure and a second end in user adjustable connection with the pivot shaft such that a torsional force is generated by positioning the two arrow support tines in an arrow shaft support position in a direction urging the two arrow support tines in a direction away from the arrow shaft support position, and a magnetic retaining assembly including a magnetic contact arm having a first contact arm end in rigid connection with the pivot shaft and a second contact arm end provided with a flat magnetically attractable contact surface, and a holding magnet affixed to the bow connecting structure at a location to magnetically attract and hold the flat magnetically attractable contact surface; the position of the two arrow support tines with respect to the magnetic contact arm being adjusted such that the two arrow support tines are in the arrow shaft support position when the flat magnetically attractable contact is magnetically held in a fixed position by a magnetic force from the holding magnet affixed to the bow connecting structure; the torsional force generated by the torsion spring being adjusted such that when the two arrow support tines are moved away from the arrow shaft support position by a force generated by an arrow shaft moving against the two arrow support tines the torsional force is sufficient to overcome the magnetic force of the holding magnet and rapidly rotate the two arrow support tines away from the arrow shaft support position such that vanes provided on a shaft end of the arrow shaft do not contact either of the two arrow support tines.

FIG. 1 shows an exemplary embodiment of the arrow rest of the present invention generally designated 10. Arrow rest 10 includes a bow connecting structure, generally designated 12; two arrow support tines, generally designated 14; a pivot shaft, generally designated 16; a biasing spring assembly, generally designated 18; and a magnetic retaining assembly, generally designated 20.

Figure 2:
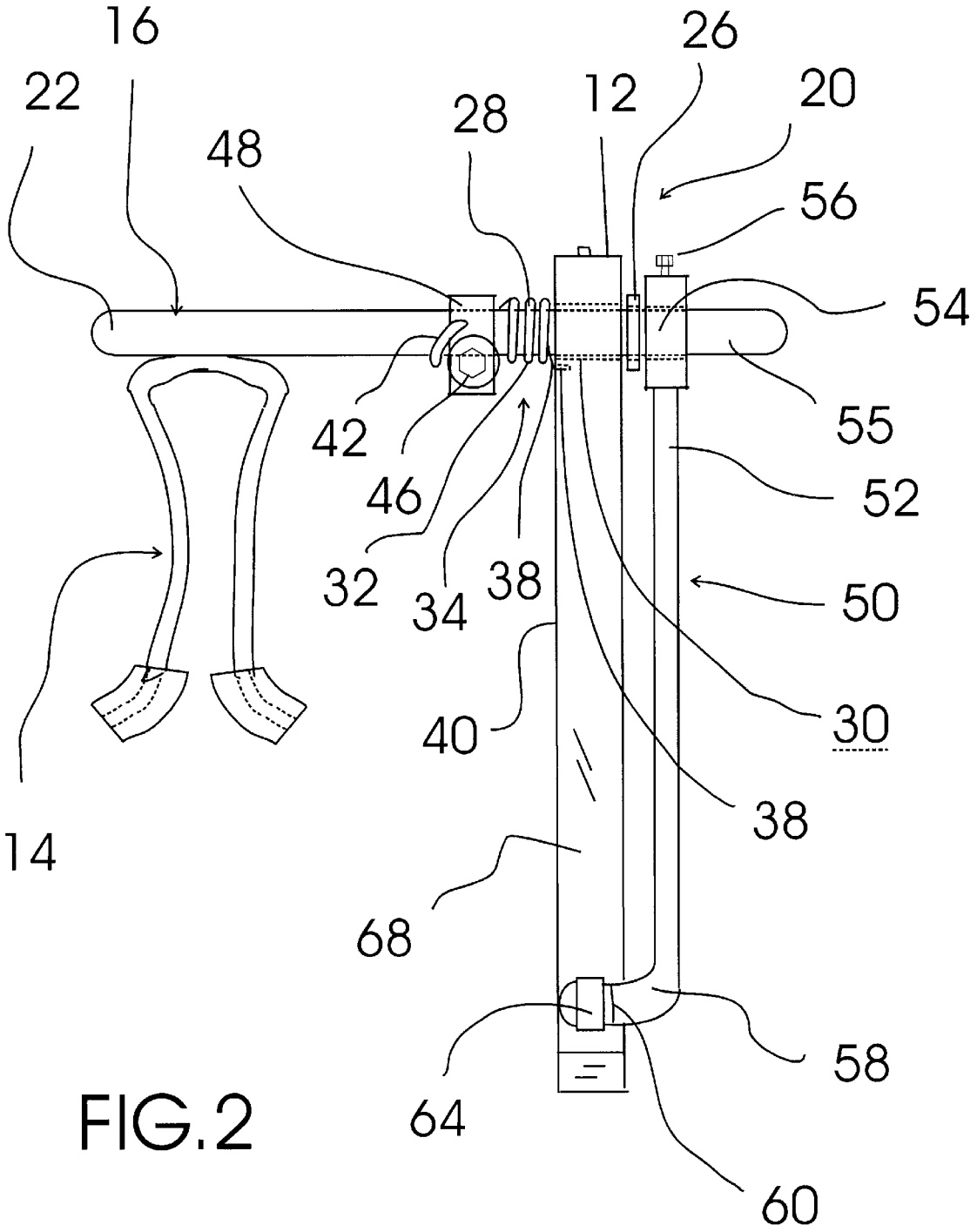
FIG. 2 is an underside plan view of the arrow rest of FIG. 1 showing the elongated plastic shaft bearing insert with a spring positioning end (shown in dashed lines) positioned through and extending past a shaft hole provided through the bow connecting structure and around which the coils of the torsion spring are positioned; and the magnetic contact arm having a first contact arm end in rigid connection with the pivot shaft with a contact arm user adjustable set screw collar and a second contact arm end provided with a non-magnetically attractable plastic tubing section positioned around the flat magnetically attractable contact surface in a manner to contact the holding magnet when the flat magnetically attractable contact is magnetically held in the fixed position by the magnetic force from the holding magnet.

Referring to FIG. 2, the two arrow support tines 14 are rigidly secured to a first end 22 of pivot shaft 16. Pivot shaft 16 is positioned through an elongated plastic shaft bearing insert 26 (a portion shown in dashed lines) with a spring positioning end 28 (shown in dashed lines) positioned through and extending past a shaft hole 30 provided through bow connecting structure 12 and around which coils 32 of a torsion spring, generally designated 34, are positioned.

Biasing spring assembly 18 (FIG. 1) includes torsion spring 34. Torsion spring 34 has a first end 38 (see also FIG. 3) inserted into a hole 36 provided into a sidewall 40 of bow connecting structure 12 and a second end 42 bent into a U-shape and positioned around a screw shaft 44 (FIG. 3) of a set screw 46 of a spring tension set screw securable adjustment collar 48 positioned on pivot shaft 16. Torsion spring 34 provides a torsional force, referring now to FIGS. 3 and 4, when the two arrow support tines 14 are positioned in an arrow shaft support position. The torsional force urges the two arrow support tines 40 in a direction "A" away from the arrow shaft support position.

Figure 3:
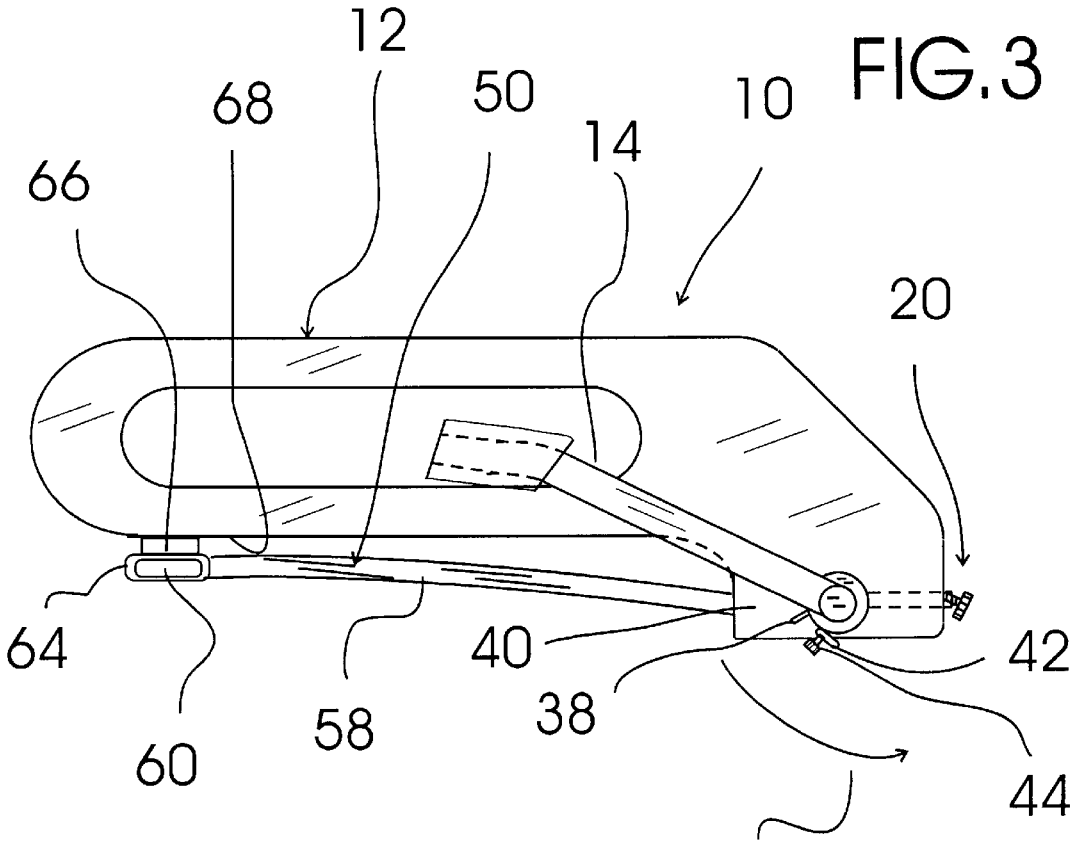
FIG. 3 is a side plan view of the arrow rest of FIG. 1 showing the first end of the torsion spring inserted into a hole provided into a sidewall of the bow connecting structure and the second end of the torsion spring bent into a U-shape and positioned around a screw shaft of set screw of a spring tension set screw securable adjustment collar.
Figure 4:
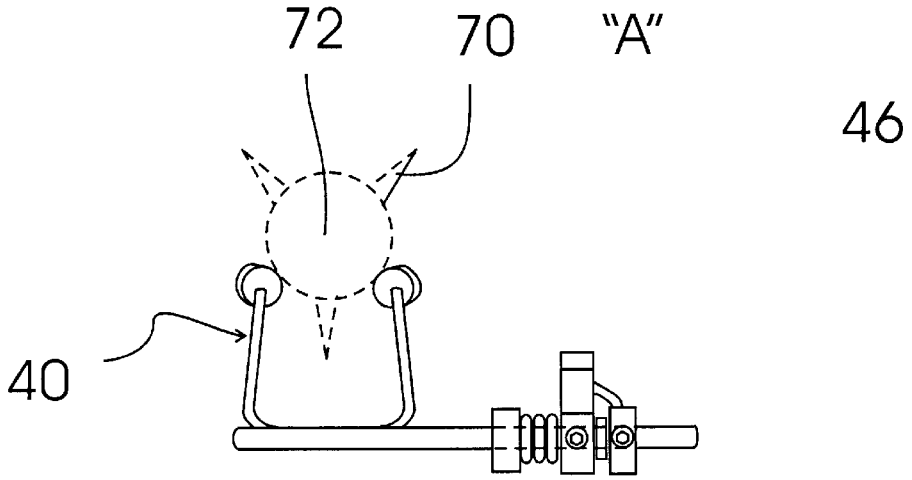
FIG. 4 is a back side plan view showing a representative arrow shaft and vanes (shown in dashed lines) positioned on the two arrow support tines.

Referring to FIGS. 2 and 3, magnetic retaining assembly 20 includes a magnetic contact arm, generally designated 50, having a first contact arm end 52 in rigid connection with a user adjustable contact arm set screw securable collar 54 which is secured to a second end 55 of pivot shaft 16 with a set screw 56 and a second contact arm end 58 provided with a flat magnetically attractable contact surface 60 that is surrounded by a non-magnetically attractable plastic tubing section 64 in a manner to contact a holding magnet 66 of magnetic retaining assembly 20 secured to a bottom surface 68 of bow connecting structure 12. Flat magnetically attractable contact 60 is magnetically held in a fixed position by magnetic force from holding magnet 66.

Figure 5:
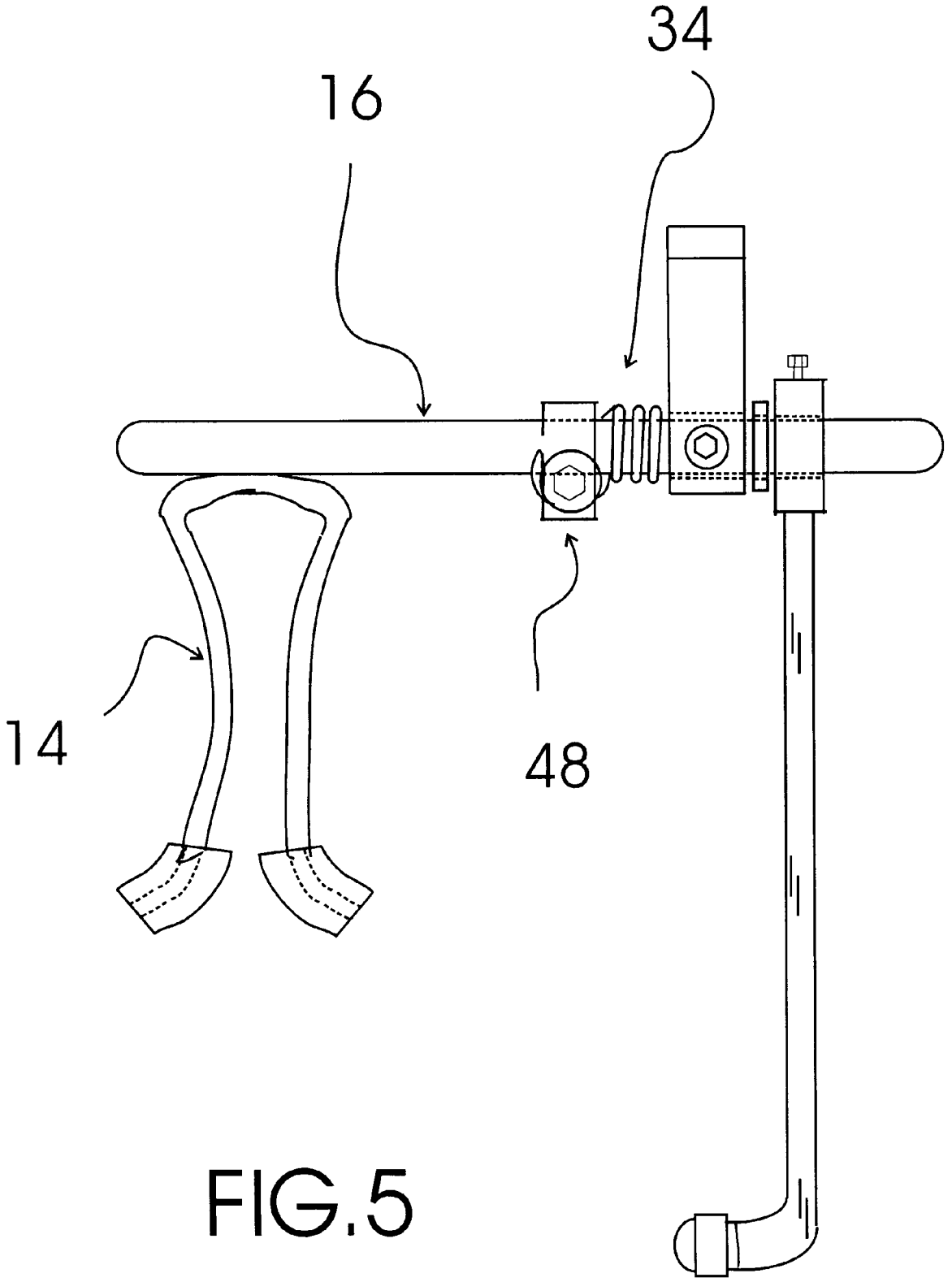
FIG. 5 is a second back side plan view showing the two arrow tines rotated out of the arrow shaft support position.

The orientation of arrow support tines 14 with respect to magnetic contact arm 50 is set such that arrow support tines 14 are in the arrow shaft support position (shown in FIG. 4) when flat magnetically attractable contact 60 is magnetically held in a fixed position by the magnetic force from holding magnet 66, Referring to FIG. 5, the torsional force generated by torsion spring 34 is adjusted by positioning spring tension set screw securable adjustment collar 48 on pivot shaft 16 such that when arrow support tines 14 are just moved away from the arrow shaft support position by a force generated by an arrow shaft moving against the arrow support tines 14 the torsional force is sufficient to overcome the magnetic force of holding magnet 66 (FIG. 3) and rapidly rotate the two arrow support tines 14 away from the arrow shaft support position such that vanes 70 (shown in dashed lines FIG. 4) provided on a shaft end 72 (shown in dashed lines FIG. 4) of the arrow shaft do not contact either of the two arrow support tines 14.

It can be seen from the preceding description that an arrow rest has been provided that includes a bow connecting structure, two arrow support tines rigidly secured to a first end of a pivot shaft rotatably entrapped in connection with the bow connecting structure, a biasing spring assembly including a torsion spring having a first end in connection with the bow connecting structure and a second end in user adjustable connection with the pivot shaft such that a torsional force is generated by positioning the two arrow support tines in an arrow shaft support position in a direction urging the two arrow support tines in a direction away from the arrow shaft support position, and a magnetic retaining assembly including a magnetic contact arm having a first contact arm end in rigid connection with the pivot shaft and a second contact arm end provided with a flat magnetically attractable contact surface, and a holding magnet affixed to the bow connecting structure at a location to magnetically attract and hold the flat magnetically attractable contact surface; the position of the two arrow support tines with respect to the magnetic contact arm being adjusted such that the two arrow support tines are in the arrow shaft support position when the flat magnetically attractable contact is magnetically held in a fixed position by a magnetic force from the holding magnet affixed to the bow connecting structure; the torsional force generated by the torsion spring being adjusted such that when the two arrow support tines are moved away from the arrow shaft support position by a force generated by an arrow shaft moving against the two arrow support tines the torsional force is sufficient to overcome the magnetic force of the holding magnet and rapidly rotate the two arrow support tines away from the arrow shaft support position such that vanes provided on a shaft end of the arrow shaft do not contact either of the two arrow support tines.

It is noted that the embodiment of the arrow rest described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An arrow rest comprising:

a bow connecting structure;

two arrow support tines rigidly secured to a first end of a pivot shaft rotatably entrapped in connection with said bow connecting structure;

a biasing spring assembly including a torsion spring having a first end in connection with said bow connecting structure and a second end in user adjustable connection with said pivot shaft such that a torsional force is generated by positioning said two arrow support tines in an arrow shaft support position in a direction urging said two arrow support tines in a direction away from said arrow shaft support position; and a magnetic retaining assembly including a magnetic contact arm having a first contact arm end in rigid connection with said pivot shaft and a second contact arm end provided with a flat magnetically attractable contact surface, and a holding magnet affixed to said bow connecting structure at a location to magnetically attract and hold said flat magnetically attractable contact surface;

the orientation of said two arrow support tines with respect to said magnetic contact arm being adjusted such that said two arrow support tines are in said arrow shaft support position when said flat magnetically attractable contact is magnetically held in a fixed position by a magnetic force from said holding magnet affixed to said bow connecting structure;

the torsional force generated by said torsion spring being adjusted such that when said two arrow support tines are moved away from said arrow shaft support position by a force generated by an arrow shaft moving against said two arrow support tines said torsional force is sufficient to overcome said magnetic force of said holding magnet and rapidly rotate said two arrow support tines away from said arrow shaft support position such that vanes provided on a shaft end of the arrow shaft do not contact either of said two arrow support tines.

2. The arrow rest of claim 1 further comprising:

an elongated plastic shaft bearing insert with a spring positioning end positioned through and extending past a shaft hole provided through said bow connecting structure and around which coils of said torsion spring are positioned.

3. The arrow rest of claim 2 wherein:

said magnetic contact arm of the arrow rest includes a user adjustable contact arm set screw collar securable to said pivot shaft and to which said first contact arm end is rigidly connected.

4. The arrow rest of claim 3 wherein:

second contact arm end is provided with a non-magnetically attractable plastic tubing section positioned around said flat magnetically attractable contact surface in a manner to contact said holding magnet when said flat magnetically attractable contact is magnetically held in said fixed position by said magnetic force from said holding magnet.

5. The arrow rest of claim 4 wherein:

said first end of the torsion spring is inserted into a hole provided into a sidewall of said bow connecting structure and said second end of said torsion spring is bent into a U-shape and positioned around a screw shaft of set screw of a spring tension set screw securable adjustment collar positioned on said pivot shaft.

6. The arrow rest of claim 3 wherein:

said first end of the torsion spring is inserted into a hole provided into a sidewall of said bow connecting structure and said second end of said torsion spring is bent into a U-shape and positioned around a screw shaft of set screw of a spring tension set screw securable adjustment collar positioned on said pivot shaft.

7. The arrow rest of claim 2 wherein:

second contact arm end is provided with a non-magnetically attractable plastic tubing section positioned around said flat magnetically attractable contact surface in a manner to contact said holding magnet when said flat magnetically attractable contact is magnetically held in said fixed position by said magnetic force from said holding magnet.

8. The arrow rest of claim 7 wherein:

said first end of the torsion spring is inserted into a hole provided into a sidewall of said bow connecting structure and said second end of said torsion spring is bent into a U-shape and positioned around a screw shaft of set screw of a spring tension set screw securable adjustment collar positioned on said pivot shaft.

9. The arrow rest of claim 2 wherein:

said first end of the torsion spring is inserted into a hole provided into a sidewall of said bow connecting structure and said second end of said torsion spring is bent into a U-shape and positioned around a screw shaft of set screw of a spring tension set screw securable adjustment collar positioned on said pivot shaft.

10. The arrow rest of claim 1 wherein:

said magnetic contact arm of the arrow rest includes a user adjustable contact set screw collar securable to said pivot shaft and to which said first contact arm end is rigidly connected.

11. The arrow rest of claim 10 wherein:

second contact arm end is provided with a non-magnetically attractable plastic tubing section positioned around said flat magnetically attractable contact surface in a manner to contact said holding magnet when said flat magnetically attractable contact is magnetically held in said fixed position by said magnetic force from said holding magnet.

12. The arrow rest of claim 11 wherein:

said first end of the torsion spring is inserted into a hole provided into a sidewall of said bow connecting structure and said second end of said torsion spring is bent into a U-shape and positioned around a screw shaft of set screw of a spring tension set screw securable adjustment collar positioned on said pivot shaft.

13. The arrow rest of claim 10 wherein:

said first end of the torsion spring is inserted into a hole provided into a sidewall of said bow connecting structure and said second end of said torsion spring is bent into a U-shape and positioned around a screw shaft of set screw of a spring tension set screw securable adjustment collar positioned on said pivot shaft.

14. The arrow rest of claim 1 wherein:

second contact arm end is provided with a non-magnetically attractable plastic tubing section positioned around said flat magnetically attractable contact surface in a manner to contact said holding magnet when said flat magnetically attractable contact is magnetically held in said fixed position by said magnetic force from said holding magnet.

15. The arrow rest of claim 14 wherein:

said first end of the torsion spring is inserted into a hole provided into a sidewall of said bow connecting structure and said second end of said torsion spring is bent into a U-shape and positioned around a screw shaft of set screw of a spring tension set screw securable adjustment collar positioned on said pivot shaft.

16. The arrow rest of claim 1 wherein:

said first end of the torsion spring is inserted into a hole provided into a sidewall of said bow connecting structure and said second end of said torsion spring is bent into a U-shape and positioned around a screw shaft of set screw of a spring tension set screw securable adjustment collar positioned on said pivot shaft.

* * * * *